US007622856B2

(12) United States Patent
Hyun

(10) Patent No.: US 7,622,856 B2
(45) Date of Patent: Nov. 24, 2009

(54) PLASMA LIGHTING SYSTEM HAVING THIN METALLIC FILM RESONATOR

(75) Inventor: Seung-Yeup Hyun, Jeju-Do (KR)

(73) Assignee: LG Electronics Inc., Seoul (KR)

( * ) Notice: Subject to any disclaimer, the term of this patent is extended or adjusted under 35 U.S.C. 154(b) by 395 days.

(21) Appl. No.: 11/535,612

(22) Filed: Sep. 27, 2006

(65) Prior Publication Data

US 2007/0075642 A1 Apr. 5, 2007

(30) Foreign Application Priority Data

Oct. 5, 2005 (KR) ..... 10-2005-0093581

(51) Int. Cl.
*H01J 23/10* (2006.01)
*H01J 25/50* (2006.01)
*H01J 25/54* (2006.01)

(52) U.S. Cl. ..... 313/153; 313/160; 315/39.51; 315/39.71

(58) Field of Classification Search ..... 313/153–162, 313/231.31, 231.71; 315/35, 39, 248, 39.51, 315/39.71

See application file for complete search history.

(56) References Cited

U.S. PATENT DOCUMENTS 5,998,934 A * 12/1999 Mimasu et al. ..... 315/118
2006/0255743 A1 11/2006 Choi et al.

FOREIGN PATENT DOCUMENTS

KR 10-2001-19882 3/2001
KR 10-20020048570 6/2002
KR 2003042725 A * 6/2003
KR 2003042729 A * 6/2003
KR 10-20030088062 11/2003

OTHER PUBLICATIONS

U.S. Appl. No. 11/554,148 to Jung et al., filed Oct. 30, 2006.
English language Abstract of KR 10-2001-19882.
English language Abstract of KR 10-2003-0088062.
English language Abstract of KR 10-2002-0048570.

* cited by examiner

*Primary Examiner*—Mariceli Santiago
(74) *Attorney, Agent, or Firm*—KED & Associates, LLP

(57) ABSTRACT

A plasma lighting system having a thin metallic film resonator includes: an electrodeless bulb emitting light by making luminous material filled therein converted into plasma state; and a resonator housing the electrodeless bulb in an inner space, transmitting the light generated from the electrodeless bulb, and blocking the microwave generated from a microwave generator and applied to the inner space from being leaked out so that a resonance mode is provided to make the electrodeless bulb emit light, wherein the resonator is a thin metallic film resonator including a thin metallic film formed in a cylindrical shape and a supporting member extended along the inner peripheral surface of the thin metallic film so as to support the thin metallic film.

9 Claims, 6 Drawing Sheets

PLASMA LIGHTING SYSTEM HAVING THIN METALLIC FILM RESONATOR

RELATED APPLICATION

The present disclosure relates to subject matter contained in priority Korean Application No. 10-2005-0093581, filed on Oct. 5, 2005, which is herein expressly incorporated by reference in its entirety.

BACKGROUND OF THE INVENTION

1. Field of the Invention

The present invention relates to a plasma lighting system having a thin metallic film resonator, and more particularly, to a plasma lighting system having a thin metallic film resonator, which can raise the luminous efficiency of an electrodeless bulb by increasing the amount of microwaves to be focused on the electrodeless bulb, and which can avoid malfunctions of other external devices in the same frequency band by preventing microwaves from leaking out of the resonator.

2. Description of the Background Art

Generally, a plasma lighting system is a lighting system in which microwave energy generated from a magnetron, a microwave generator, is transmitted to a resonator through a waveguide, and is applied to an electrodeless bulb installed in the resonator so that gas filled in the electrodeless bulb is excited and converted into a plasma state to generate light.

The electrodeless bulb does not include an electrode or a filament therein, thus the plasma lighting system has longer or semipermanent life span. The filler material filled in the electrodeless bulb emit light by being transformed into a plasma state to thus generate light that closely resembles natural light.

FIG. 1 is a plane view showing a structure of a conventional plasma lighting system. FIG. 2 is a line cross-sectional view taken along line 11-11 of FIG. 1.

As shown therein, the conventional plasma lighting system includes: a high voltage generator 20 generating a high voltage when electric power is applied to an inner space of a casing 10; a microwave generator 30 generating a microwave having a high frequency when the high voltage generated from the high voltage generator 20 is applied; a waveguide 40 guiding the microwave applied from the microwave generator 30; a resonator 50 provided outside the casing, for shielding the microwave guided by the waveguide 40 from being leaked out to provide a resonance mode; and an electrodeless bulb 60 rotatably arranged at the center of the resonator 50, for generating light by transforming inert gas enclosed therein into a plasma state.

The waveguide 40 is a cylindrical tube, whose one side is connected to the microwave generator 30. A resonator coupling member 41 having a predetermined height is protruded on the upper end face of the waveguide 40 along the height direction of the waveguide 40.

The resonator coupling member 41 is formed in a ring shape having a smaller diameter than the waveguide 40, the center of which is penetrated at the center, and an outer surface of which is fixed and coupled to the resonator 50.

The resonator 50 is formed of a cylindrical mesh 51 having a net structure so that the electrodeless bulb 60 is housed in an inner space, the microwave is blocked from being leaked out and then transmitted to the electrodeless bulb 60, and the light generated from the electrodeless bulb 60 can be transmitted to the outside. The outer profile of the resonator 50 is formed of steel so as to maintain its cylindrical form.

A mirror 70 is formed in a disc shape having the same diameter as the resonator coupling member 41, and arranged so as to be in contact with the upper end face of the resonator coupling member 41. The electrodeless bulb 60 is provided at the center of the mirror 70 so as to extend to a predetermined length along the height direction of the waveguide 40 and be exposed to the outside of the waveguide 40.

Meanwhile, the electrodeless bulb 60 includes a bulb-shaped luminous unit 61 having a predetermined inner volume in which a filler material is enclosed, and a fixing unit 62 extended integral with the luminous unit 61 and formed of the same material as the luminous unit 61.

The luminous unit 61 is installed inside the casing 10, and the fixing unit 62 is installed to penetrate through the center portion of the waveguide 40. The fixing unit 62 installed together with the luminous unit 61 is connected to a motor shaft of a driving motor 90 installed in the casing 10 and rotates at a predetermined speed.

Preferably, the luminous unit 61 is mainly made of a material, such as quartz, having a high transmittance and an extremely small dielectric loss. The filler material to be enclosed in the luminous unit 61 is mainly made of luminous materials, such as metal, halogen compound, sulphur, and selenium, inert gases, such as argon gas and krypton gas, for forming plasma in the luminous unit 61, and discharge solvent materials, such as mercury, for making lighting easier by assisting an initial discharge or controlling the spectrum of generated light or the like.

In the drawings, unexplained reference numerals 70 denotes a mirror, 80 denotes a reflecting shade, 100 denotes a cooling fan, 110 denotes a second driving motor for rotating the cooling fan, and 120 denotes an air duct.

According to the above-said construction of the conventional plasma lighting system, when a driving signal is inputted to the high voltage generator 20, the high voltage generator 20 raises AC power and supplies the raised high voltage to the microwave generator 30. The microwave generator 30 oscillates by a high voltage to thereby generate microwaves having a very high frequency.

The microwaves are emitted into the resonator 50 through the waveguide 40, and then the inert gas filled in the electrodeless bulb 60 is excited to continually transform the luminous material into a plasma state so as to emit light having an intrinsic emission spectrum. The light reaches the surface of the mirror 70 arranged at the rear side of the electrodeless bulb 60 and is reflected on the front side of the electrodeless bulb 60, thereby lighting a space.

However, in such a conventional plasma lighting system, if the microwaves generated in the microwave generator 30 are guided by the waveguide 40 to provide a resonance mode inside the resonator 50, parts of the microwaves are leaked out via openings of the mesh 51 of the resonator 50 and thus, the amount of microwaves to be focused on the electrodeless bulb 60 is reduced, thereby decreasing the optical efficiency of the electrodeless bulb 60. Further, malfunctions may occurred to other external devices in the same frequency band with the leaked microwaves.

SUMMARY OF THE INVENTION

Therefore, an object of the present invention is to provide a plasma lighting system having a thin metallic film resonator, which can raise the luminous efficiency of an electrodeless bulb by increasing the amount of microwaves to be focused on the electrodeless bulb, and which can avoid malfunctions of other external devices in the same frequency band by preventing microwaves from leaking out of the resonator.

To achieve these and other advantages and in accordance with the purpose of the present invention, as embodied and broadly described herein, there is provided a plasma lighting system having a thin metallic film resonator, including: an electrodeless bulb emitting light by making luminous material filled therein converted into plasma state; and a resonator housing the electrodeless bulb in an inner space, transmitting the light generated from the electrodeless bulb, and blocking the microwave generated from a microwave generator and applied to the inner space from being leaked out so that a resonance mode is provided to make the electrodeless bulb emit light, wherein the resonator is a thin metallic film resonator including a thin metallic film formed in a cylindrical shape and a supporting member extended along the inner peripheral surface of the thin metallic film so as to support the thin metallic film.

It is effective that the thin metallic film is formed of any one metal of gold, silver, copper, and aluminum.

This is to easily provide a resonance mode in the resonator and to increase the amount of microwaves to be focused on the electrodeless bulb by forming the thin metallic film from a metal having a high conductivity.

Furthermore, the supporting member is preferably formed of a glass material.

This is to transmit light generated from the electrodeless bulb to the outside and to reduce the loss of light at the time of transmission.

Furthermore, it is effective that a cylindrical thin metallic film is further provided on the inner peripheral surface of the supporting member.

This is to reduce the amount of microwaves to be leaked out of the resonator by providing a thin metallic film dually on the inner and outer peripheral surfaces of the supporting member around the supporting member.

Moreover, it is effective that a mesh type resonator having a cylindrical porous mesh structure is further provided on the inner peripheral surface of the thin metallic film resonator.

This is to easily provide a resonance mode in the resonator and to increase the amount of microwaves to be focused on the electrodeless bulb by contacting the thin metallic film and the mesh type resonator and improving the conductivity therebetween.

Preferably, a mesh type resonator having a cylindrical porous mesh structure is further provided on the outer peripheral surface of the thin metallic film resonator.

This is to easily install the mesh type resonator on the thin metallic film resonator in manufacturing the plasma lighting system.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
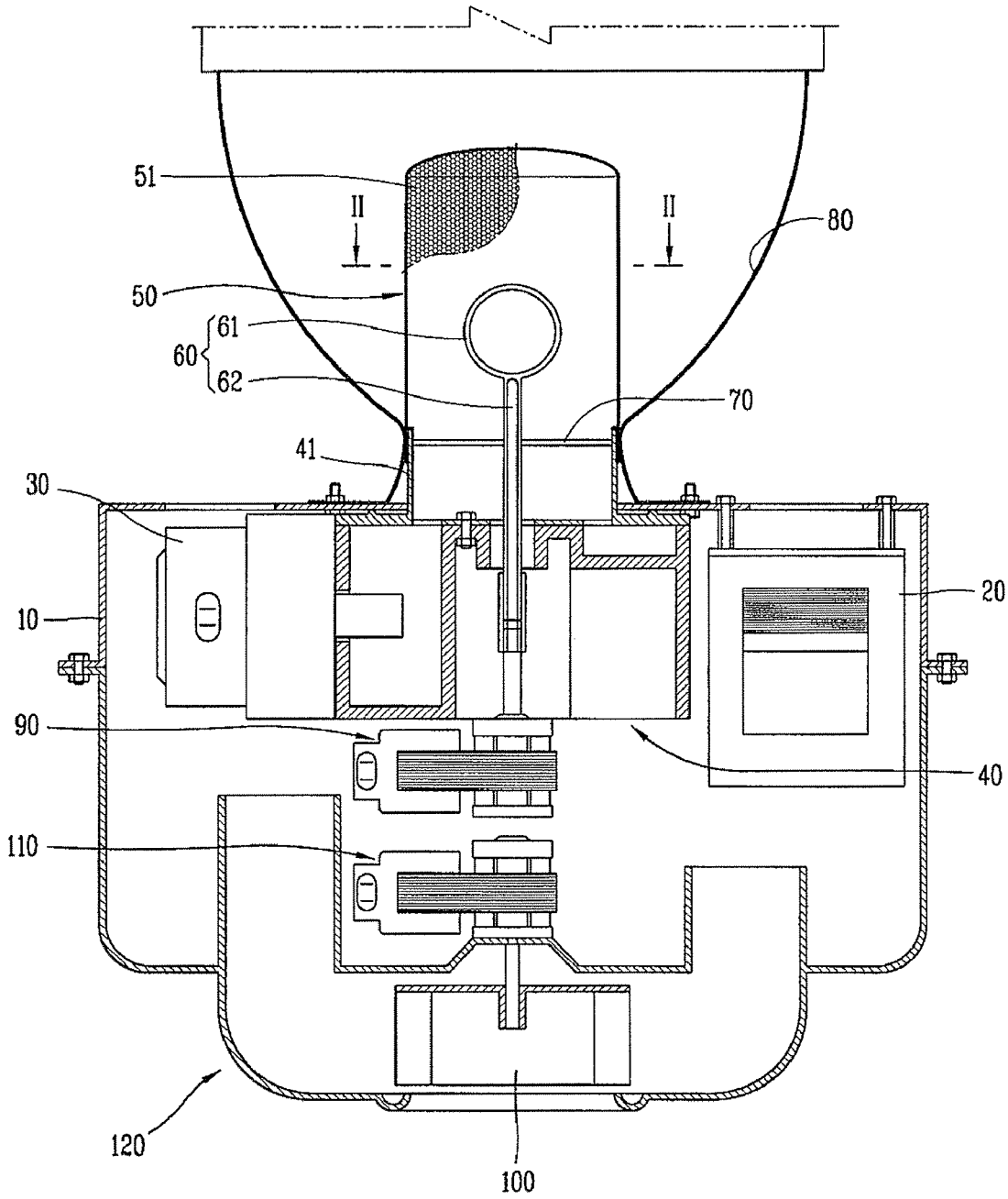
FIG. 1 CONVENTIONAL ART
FIG. 1 is a plane view showing a structure of a conventional plasma lighting system.
Figure 2:
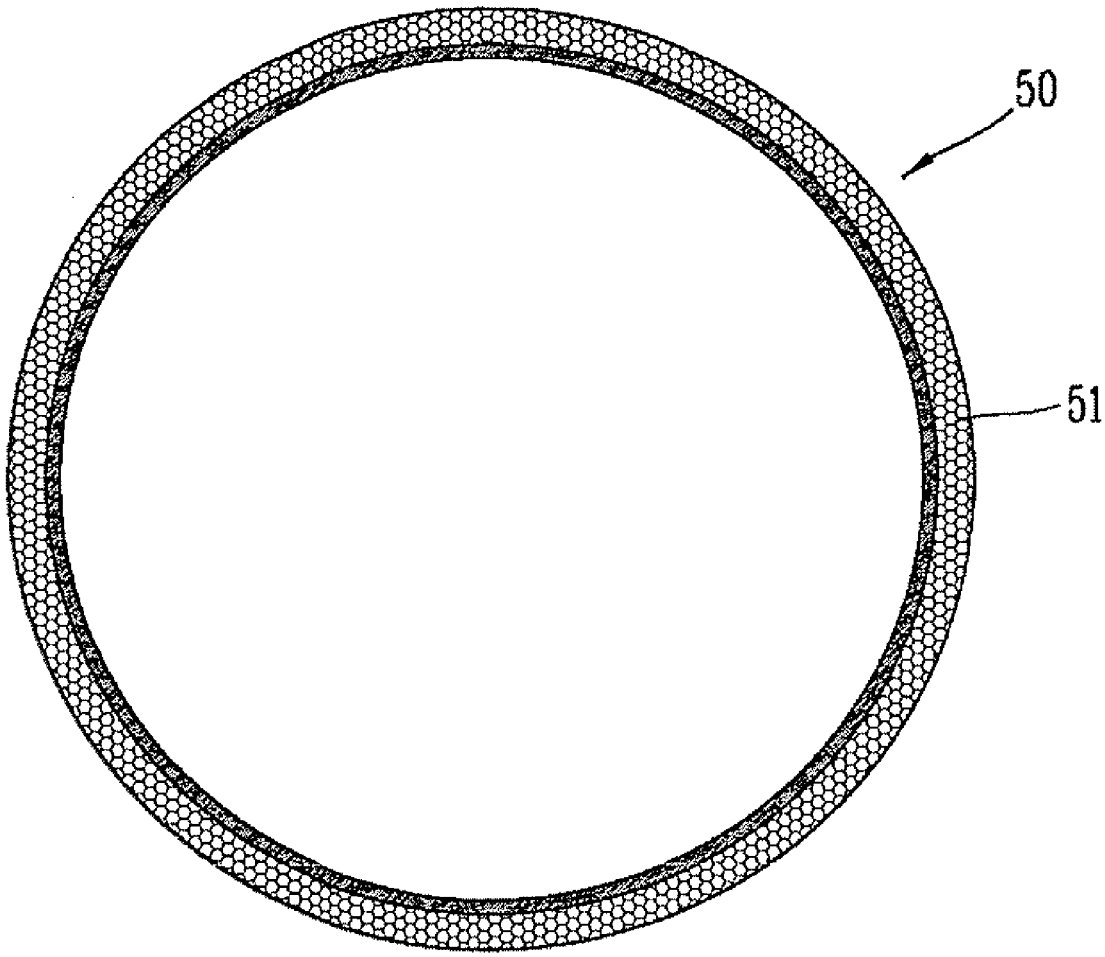
FIG. 2 CONVENTIONAL ART
FIG. 2 is a line cross-sectional view taken along line II-II of FIG. 1.

Hereinafter, the present invention will be described in detail with reference to the accompanying drawings.

Like reference numerals are used to designate like elements of the conventional construction, and a detailed description thereof will be omitted.

Figure 3:
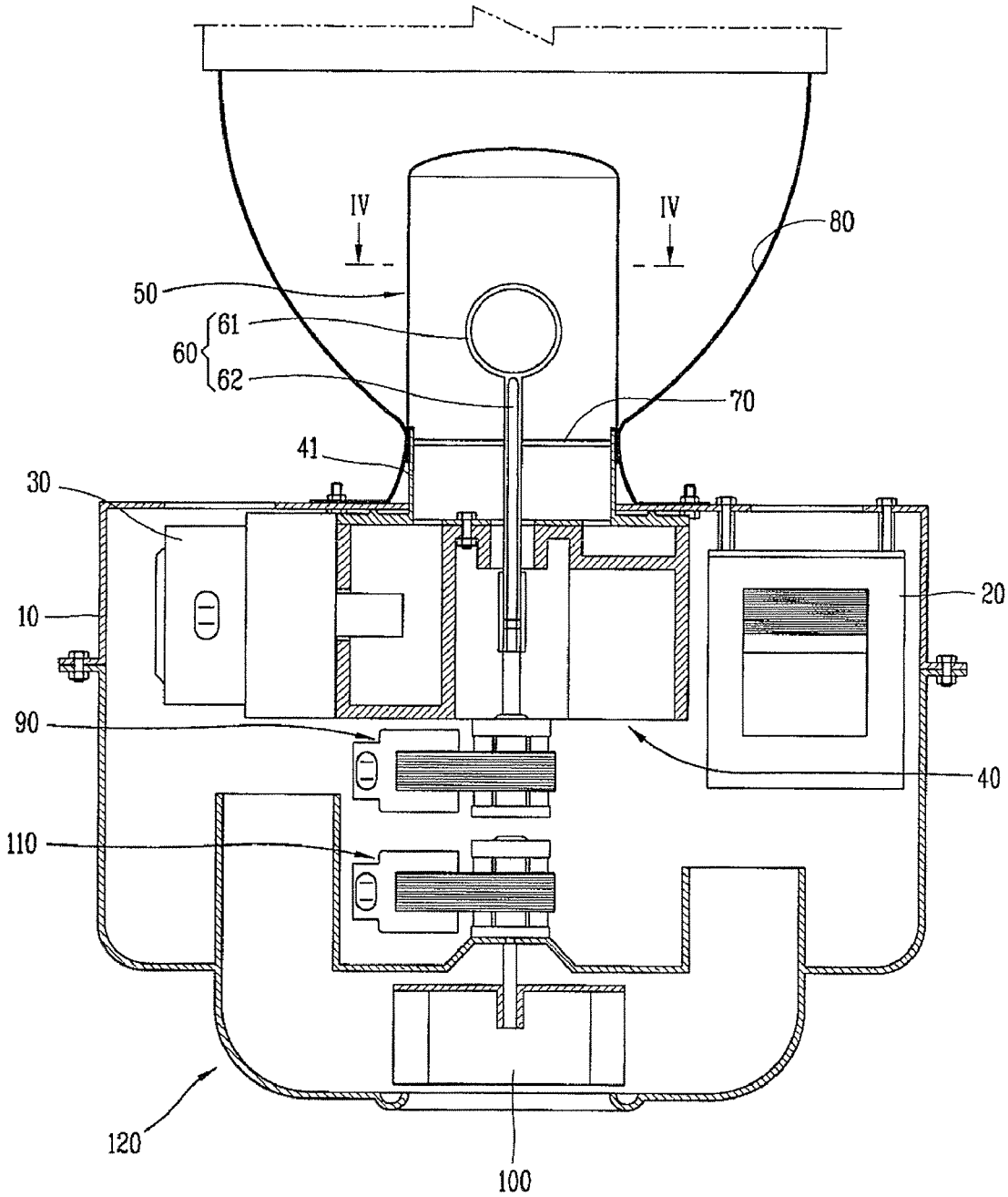
FIG. 3 is a cross sectional view of a plasma lighting system having a thin metallic film resonator in accordance with one embodiment of the present invention.
Figure 4A:
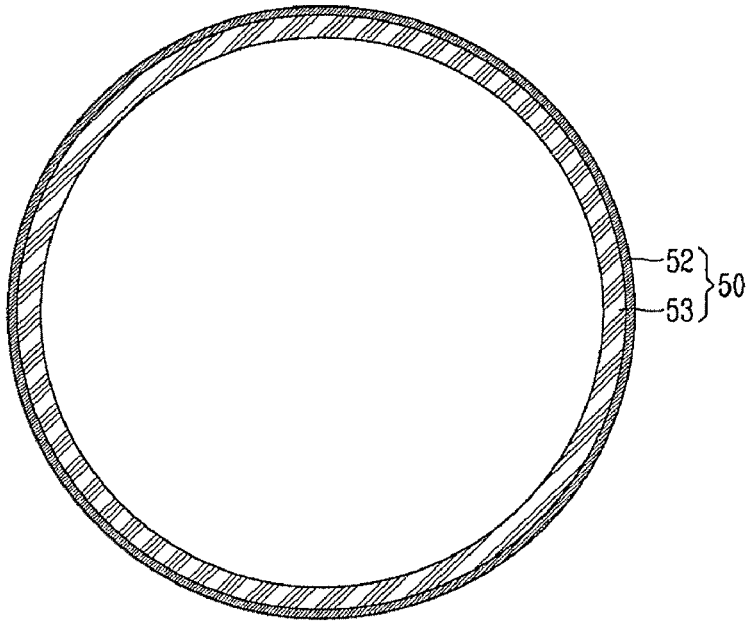
FIGS. 4A and 4B are line cross sectional views taken along line IV-IV of FIG. 3.
Figure 4B:
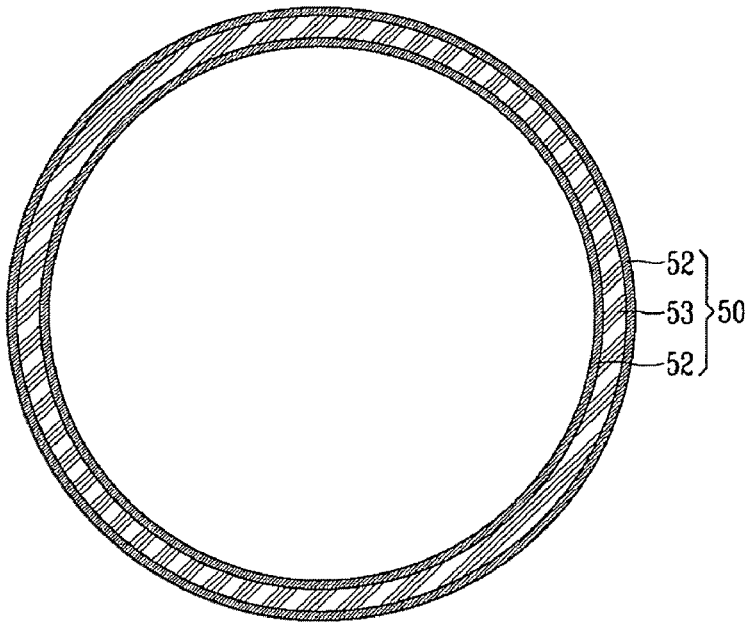
Figure 5A:
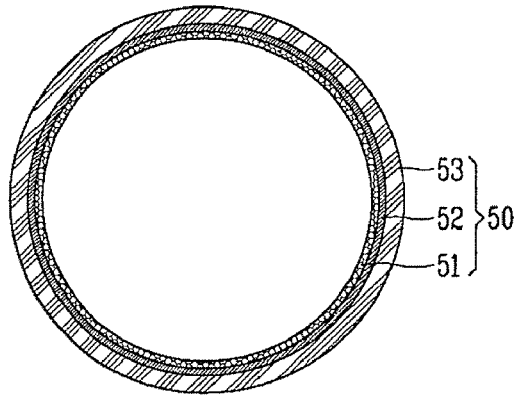
FIGS. 5A through 5C are cross sectional views of a plasma lighting system having a thin metallic film resonator in accordance with another embodiment of the present invention.
Figure 5B:
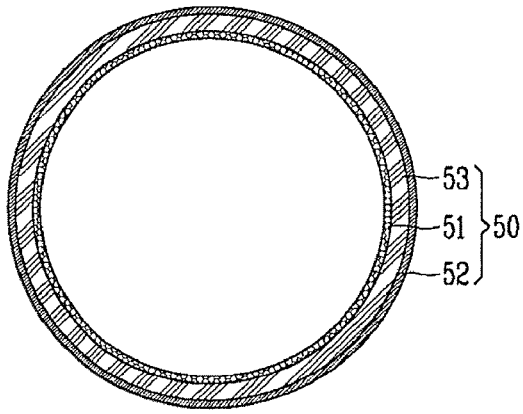
Figure 5C:
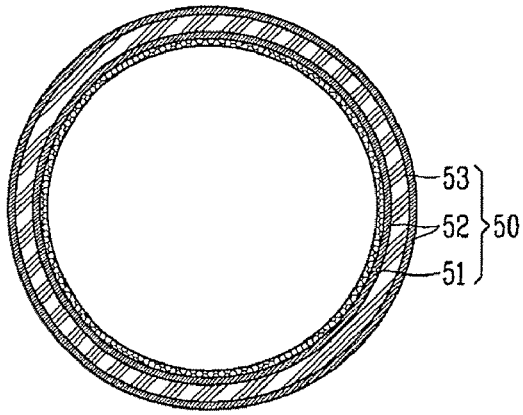
Figure 6A:
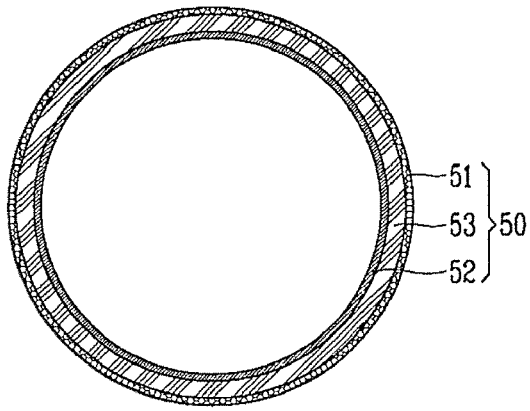
FIGS. 6A through 6C are cross sectional views of a plasma lighting system having a thin metallic film resonator in accordance with still another embodiment of the present invention.
Figure 6B:
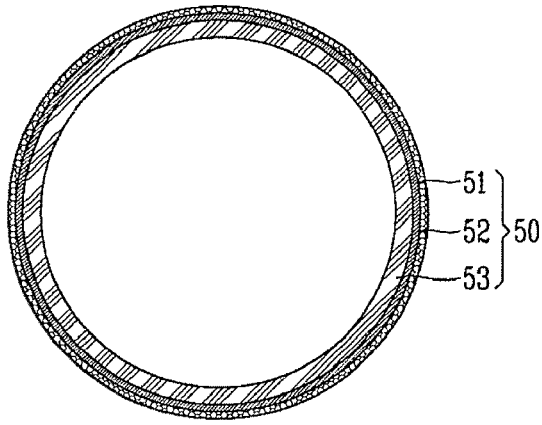
Figure 6C:
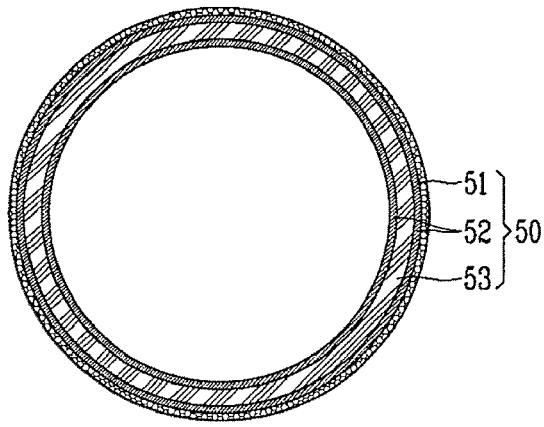

FIG. 3 is a cross sectional view of a plasma lighting system having a thin metallic film resonator in accordance with one embodiment of the present invention. FIGS. 4A and 4B are line cross sectional views taken along line IV-IV of FIG. 3. FIGS. 5A through 5C are cross sectional views of a plasma lighting system having a thin metallic film resonator in accordance with another embodiment of the present invention. FIGS. 6A through 6C are cross sectional views of a plasma lighting system having a thin metallic film resonator in accordance with still another embodiment of the present invention.

As shown in these drawings, a plasma lighting system having a thin metallic film resonator in accordance with one embodiment of the present invention includes: an electrodeless bulb 60 emitting light by making luminous material filled therein converted into plasma state; and a resonator 50 housing the electrodeless bulb 60 in an inner space, transmitting the light generated from the electrodeless bulb 60, and blocking the microwave generated from a microwave generator 30 applied to the inner space from being leaked out so that a resonance mode is provided to make the electrodeless bulb emit light, wherein the resonator 50 includes a thin metallic film 52 formed in a cylindrical shape and a supporting member 53 extended along the inner peripheral surface of the thin metallic film 52 so as to support the thin metallic film 52.

As shown in FIGS. 4A and 4B, the thin metallic film transistor in accordance with one embodiment of the present invention includes a thin metallic film 52 formed in a cylindrical shape and a supporting member 53 provided on the inner peripheral surface or outer peripheral surface of the thin metallic film 52 so as to allow the thin metallic film 52 to maintain a cylindrical shape.

Since the thin metallic film 52 is implemented in a thin film made of a material having a high conductivity, such as gold, silver, copper, and aluminum, openings provided at the conventional mesh 51 type resonator 50 are not required.

The supporting member 53 is formed of a material, such as glass, with less light loss and good transmittance of light.

As shown in FIGS. 5A through 5C, the thin metallic film transistor in accordance with another embodiment of the present invention includes a thin metallic film 52 formed in a cylindrical shape, a supporting member 53 provided on the inner peripheral surface or outer peripheral surface of the thin metallic film 52 so as to allow the thin metallic film 52 to maintain a cylindrical shape, and a mesh 51 type resonator 50 provided on the inner peripheral surface of the supporting member 53.

Since the thin metallic film 52 is implemented in a thin film made of a material having a high conductivity, such as gold, silver, copper, and aluminum, openings provided at the conventional mesh 51 type resonator 50 are not required.

The supporting member 53 is formed of a material, such as glass, with less light loss and good transmittance of light. In order to prevent the microwave applied into the resonator 50 from being leaked out of the resonator 50, the thin metallic film 52 may be installed dually on the inner peripheral surface and outer peripheral surface of the supporting member 53.

If the mesh 51 type resonator 50 is installed on the inner peripheral surface of the supporting member 53, it is contacted with the plate surface of the thin metallic film 52 and the plate surface of the mesh 51 type resonator 50 to thus increase the conductivity therebetween, thereby making it easy to provide a resonance mode of the resonator 50.

As shown in FIGS. 6A through 6C, the thin metallic film transistor in accordance with still another embodiment of the present invention includes a thin metallic film 52 formed in a cylindrical shape, a supporting member 53 provided on the inner peripheral surface or outer peripheral surface of the thin metallic film 52 so as to allow the thin metallic film 52 to maintain a cylindrical shape, and a mesh 51 type resonator 50 provided on the outer peripheral surface of the supporting member 53.

Since the thin metallic film 52 is implemented in a thin film made of a material having a high conductivity, such as gold, silver, copper, and aluminum, openings provided at the conventional mesh 51 type resonator 50 are not required.

The supporting member 53 is formed of a material, such as glass, with less light loss and good transmittance of light. In order to prevent the microwave applied into the resonator 50 from being leaked out of the resonator 50, the thin metallic film 52 may be installed dually on the inner peripheral surface and outer peripheral surface of the supporting member 53.

Though the installation of the mesh 51 type resonator 50 on the outer peripheral surface of the supporting member 53 does not provided the effect of maintaining conductivity by contact with the plate surface of the thin metallic film 52 and the plate surface of the mesh 51 type resonator 50, it has the advantage that it is easy to manufacture a resonator in the manufacture of a plasma lighting system because the mesh 51 type resonator 50 is of such a structure as to be exposed to the outside.

According to the above-said construction of the plasma lighting system having a thin metallic film resonator in accordance with the present invention, when a driving signal is inputted to the high voltage generator 20, the high voltage generator 20 raises AC power and supplies the raised high voltage to the microwave generator 30. The microwave generator 30 oscillates by a high voltage to thereby generate microwaves having a very high frequency.

The microwaves are emitted into the resonator 50 through the waveguide 40, and then the inert gas filled in the electrodeless bulb 60 is excited to continually transform the luminous material into a plasma state. At this point, the thin metallic film 52 of the resonator 50 has a thickness of several micrometers (μm), which is very thin, thus it has the characteristic that light is transmitted and most parts of microwaves are reflected so that the microwaves can be prevented from being leaked out. By forming a cylindrical resonator 50 using such a thin metallic film 52, the microwaves in the resonator 50 are reflected inside the resonator 50 and focused on the electrodeless bulb 60, thereby transmitting a microwave energy to the electrodeless bulb 60.

The electrodeless bulb 50 having received such a microwave energy generates light having an intrinsic emission spectrum. The light reaches the surface of the mirror 70 arranged at the rear side of the electrodeless bulb 60 and is reflected on the front side of the electrodeless bulb 60, thereby lighting a space.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A plasma lighting system, comprising:

an electrodeless bulb emitting light by making luminous material filled therein converted into plasma state;

a thin metallic film resonator provided with a first cylindrical thin metallic film housing the electrodeless bulb in an inner space and forming a resonance mode, a supporting member extended along an inner peripheral surface of the first cylindrical thin metallic film so as to support the first cylindrical thin metallic film; and a second cylindrical thin metallic film being further provided on the inner peripheral surface of the supporting member.

2. The plasma lighting system of claim 1, wherein at least one of the first and second cylindrical thin metallic films is formed of any one metal having a high conductivity of gold, silver, copper, and aluminum.

3. The plasma lighting system of claim 1, wherein the supporting member is formed of a glass material which can transmit light and shows less loss of transmitted light.

4. A plasma lighting system, comprising:

an electrodeless bulb emitting light by making luminous material filled therein converted into plasma state;

a thin metallic film resonator provided with a cylindrical thin metallic film housing the electrodeless bulb in an inner space and forming a resonance mode, and a supporting member extended along an inner peripheral surface of the cylindrical thin metallic film so as to support the cylindrical thin metallic film; and a mesh type resonator having a cylindrical porous mesh structure provided on an outer peripheral surface or an inner peripheral surface of the cylindrical thin metallic film resonator.

5. The plasma lighting system of claim 4, wherein the thin metallic film is formed of any one metal having a high conductivity of gold, silver, copper, and aluminum.

6. The plasma lighting system of claim 4, wherein the supporting member is formed of a glass material which can transmit light and shows less loss of transmitted light.

7. A plasma lighting system, comprising;

an electrodeless bulb emitting light by making luminous material filled therein converted into plasma state;

a thin metallic film resonator provided with a first cylindrical thin metallic film housing the electrodeless bulb in an inner space and forming a resonance mode, and a supporting member extended along an inner peripheral surface of the first cylindrical thin metallic film so as to support the first cylindrical thin metallic film;

a second cylindrical thin metallic film provided on an inner peripheral surface of the supporting member; and a mesh type resonator having a cylindrical porous mesh structure provided on an outer peripheral surface or an inner peripheral surface of the thin metallic film resonator.

8. The plasma lighting system of claim 7, wherein at least one of the first and second cylindrical thin metallic films is formed of any one metal having a high conductivity of gold, silver, copper, and aluminum.

9. The plasma lighting system of claim 7, wherein the supporting member is formed of a glass material which can transmit light and shows less loss of transmitted light.

* * * * *